US008336709B1

(12) United States Patent
Geibel

(10) Patent No.: US 8,336,709 B1
(45) Date of Patent: Dec. 25, 2012

(54) MAGNETIC TOOL HOLDER

(76) Inventor: Ronald J. Geibel, Schaumburg, IL (US)

( * ) Notice: Subject to any disclaimer, the term of this patent is extended or adjusted under 35 U.S.C. 154(b) by 87 days.

(21) Appl. No.: 12/927,219

(22) Filed: Nov. 10, 2010

Related U.S. Application Data

(63) Continuation-in-part of application No. 12/231,581, filed on Sep. 4, 2008, now Pat. No. 7,905,354.

(51) Int. Cl.
*B65D 85/20* (2006.01)

(52) U.S. Cl. ..... 206/378; 206/350; 206/493

(58) Field of Classification Search ..... 206/350, 206/378, 375, 376, 493; 211/70.6, 69.5
See application file for complete search history.

(56) References Cited

U.S. PATENT DOCUMENTS

| | | | | | |
|---|---|---|---|---|---|
| 4,621,738 | A * | 11/1986 | DeLucchi | ..... | 211/70.6 |
| 4,927,020 | A * | 5/1990 | Randy | ..... | 206/378 |
| 5,645,177 | A * | 7/1997 | Lin | ..... | 211/70.6 |
| 5,992,626 | A * | 11/1999 | Anderson | ..... | 206/378 |
| 6,386,363 | B1 * | 5/2002 | Huang | ..... | 206/378 |
| 6,431,373 | B1 * | 8/2002 | Blick | ..... | 211/70.6 |
| 6,488,151 | B2 * | 12/2002 | Ramsey et al. | ..... | 206/378 |
| 7,152,747 | B2 * | 12/2006 | Wang | ..... | 211/70.6 |
| 7,190,248 | B2 * | 3/2007 | Coleman et al. | ..... | 335/285 |
| 2003/0233926 | A1 * | 12/2003 | Makropoulos | ..... | 83/829 |

* cited by examiner

*Primary Examiner* — J. Gregory Pickett
*Assistant Examiner* — Ernesto Grano
(74) *Attorney, Agent, or Firm* — Mathew R. P. Perrone, Jr.

(57) ABSTRACT

A tool holder has a housing with magnets mounted therein with a slot therebetween and movable pegs therein cooperating to hold a series of sockets, or a series of screw drivers or bits therefor, or a series of wrenches, or other tools, or combinations thereof, mounted at a desired position on the tool holder.

10 Claims, 15 Drawing Sheets

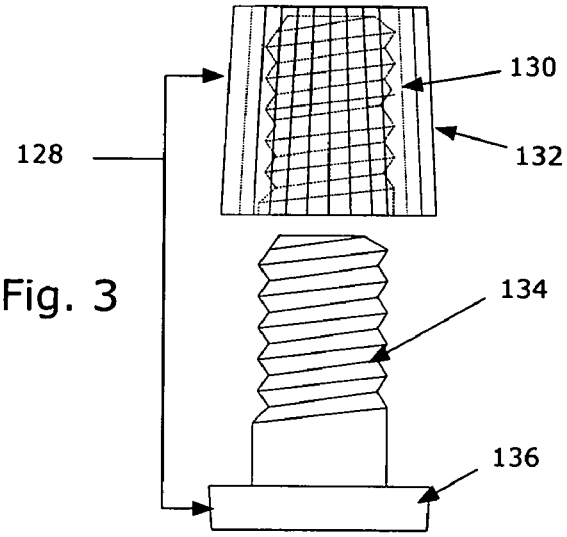
Fig. 3
Fig. 5
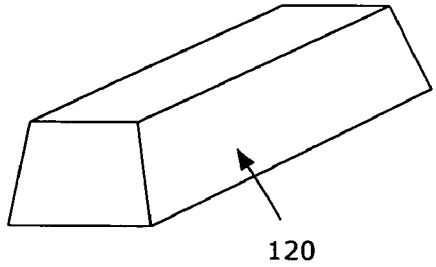
Fig. 6
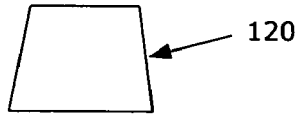
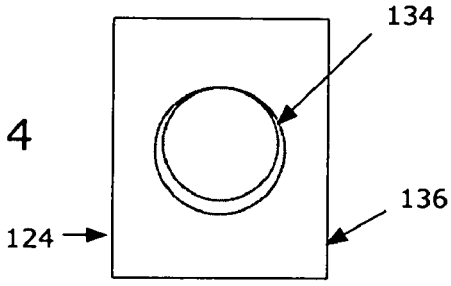
Fig. 4
Fig. 4a
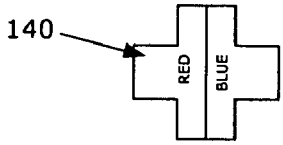

MAGNETIC TOOL HOLDER

CROSS REFERENCE TO RELATED APPLICATIONS

This application is a continuation in part of U.S. patent application Ser. No. 12/231,581, filed Sep. 4, 2008, now U.S. Pat. No. 7,905,354; filed by the same inventive entity and incorporated herein by reference.

This invention relates to a magnetic tool holder, and more particularly, to a magnetic tool holder which cooperates with a magnetic socket track, in order to support sockets and driver bits on a surface.

BACKGROUND OF THE INVENTION

For a mechanic, it is very desirable to have good access to tools. Such access requires the visibility along with ease of removal and replacement. In U.S. Pat. No. 5,501,342 to Ronald J. Geibel; who is the applicant in this application, and which patent is incorporated herein by reference; is disclosed a magnetic strip mounted in a plastic housing for holding sockets in a desired position. Each socket has an appropriate aperture, which receives a fitting on that magnetic socket track.

This magnetic socket track can be even more useful, if it can be made thinner. A single channel with a single magnet interferes with a thin magnetic socket track. A mechanic needs a thin socket holder so that tall sockets clear of the drawer when the socket track is placed therein, and the drawer is then closed.

Clearly a mechanic can require screwdriver bits as well as sockets. Thus, it can be very useful to have screwdriver bits on that magnetic socket track.

Adjustability of the magnetic socket track is very desirable. If the various pins on the magnetic sidetrack can be adjusted, the sockets can be moved to a more desirable position. Also, with the ease of adjustability, the sockets in the magnetic socket track, may have a changed position more suitable for convenience of the user.

Typically, a mechanic will have a large tool case, with many compartments and drawers therein. Sometimes, a device for holding sockets in a desired position is rendered ineffective, because the sockets on the tool holder become too tall to permit the drawer to close efficiently. With this problem, such a tool holder does not permit the sockets to be readily available.

Driving bits are also important tools. So if driving bits can be held efficiently, additional advantages can be obtained. The driving bits become more accessible and visible. Thus, they become easier to use.

SUMMARY OF THE INVENTION

Among the many objectives of this invention is the provision of a magnetic tool holder, which permits sockets and bits to be used in efficient fashion.

A further objective of this invention is the provision of a magnetic tool holder, which permits sockets to clear the closing drawer.

Yet a further objective of this invention is the provision of a magnetic tool holder, which is easily adjustable.

A still further objective of this invention is the provision of a magnetic tool holder, which holds sockets.

Another objective of this invention is the provision of a magnetic tool holder, which is easily mounted.

Yet another objective of this invention is the provision of a magnetic tool holder, which is easily transported.

Still another object of this invention is the provision of a magnetic tool holder, which can be modified to hold driving bits.

These and other objectives of the invention (which other objectives become clear by consideration of the specification, claims and drawings as a whole) are met by providing a tool holder, which has magnets and movable pegs cooperating to hold a series of sockets, or a series of screw drivers or bits therefor, or a series of wrenches, or combinations thereof, each being mounted at a desired position on the tool holder, the magnetic holding being accomplished with a dovetail magnetic element mounted on both sides of a series of movable pegs.

BRIEF DESCRIPTION OF THE DRAWINGS

FIG. 3 depicts an exploded side view of socket holder assembly 128 for tool holder 100 of this invention.

FIG. 4 depicts a top plan view of T-shaped stud 124 for socket holder assembly 128 used with tool holder 100 of this invention.

FIG. 4*a* depicts an end view of a colored rod 140 for tool holder 100 of this invention.

FIG. 5 depicts a perspective view of a dovetail magnetic segment 120 for tool holder 100 of this invention.

FIG. 6 depicts an end plan view of a dovetail magnetic segment 120 for tool holder 100 of this invention.

Throughout the figures of the drawings, where the same part appears in more than one figure of the drawings, the same number is applied thereto.

DESCRIPTION OF THE PREFERRED EMBODIMENTS

Figure 1:
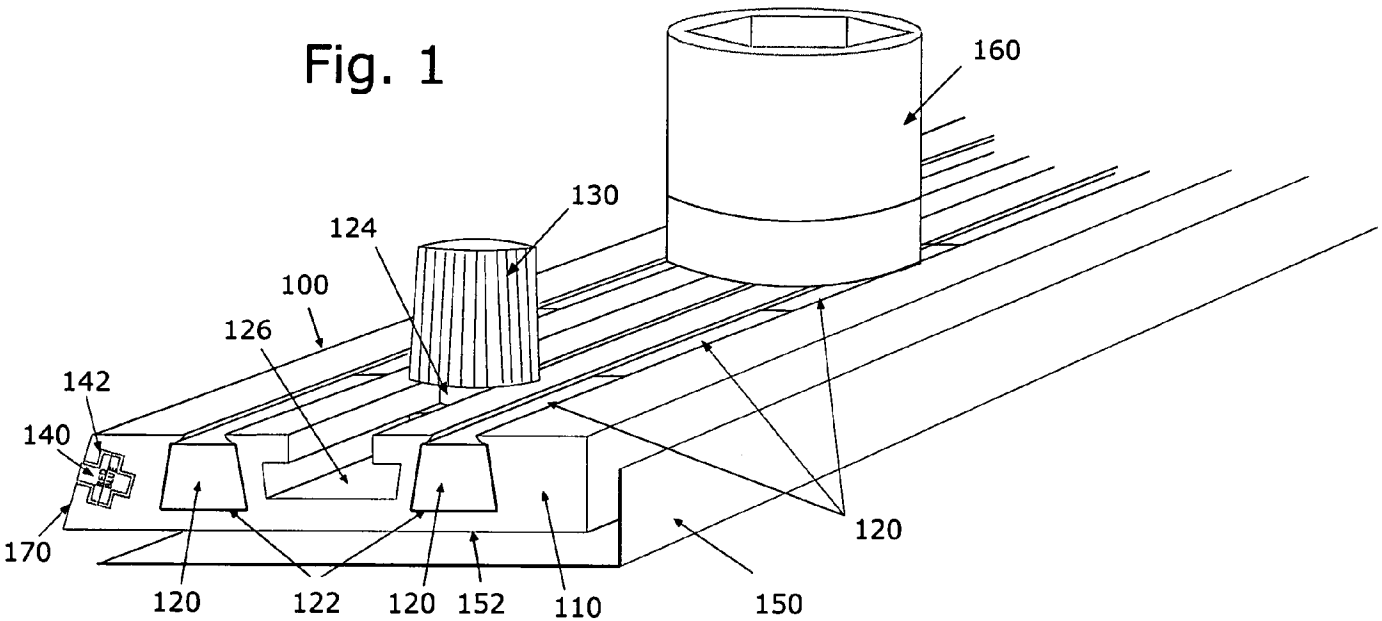
FIG. 1 depicts a perspective view of the tool holder 100 of this invention.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, over, above, below, beneath, rear, and front, may be used with respect to the drawings. These and similar to directional terms are not to be construed to limit the scope of the invention in any manner. The words attach, connect, couple, and similar terms with their inflectional morphemes do not necessarily denote direct or intermediate connections, but may also include connections through mediate elements or devices.

The tool holder of this invention can hold sockets and other tools. As a socket holder, it is a very thin tool storage device, with movable pegs which can be tightened in any desired position on the rail of the tool housing of the tool holder. Each of these pegs locates or positions a socket or other tool in a desired position, while a powerful magnetic force holds the sockets in place.

Any desired number of peg sizes can be used. Typically, the peg sizes store one quarter inch drive sockets, three eights inch drive sockets, and one half inch drive sockets of the English or metric type. To remove a desired socket or other tool, one need only provide a slight tilt and a lift to the desired socket or other tool.

Once the tool holder is loaded with sockets or other tools, the magnetic force on the bottom of the rail permits the tool holder to be attached to a metal toolbox drawer. The magnet prevents movement of the tool holder within the drawer. Because the structure of the tool holder is so low, the tool holder does not interfere with the operation of the drawer relative to the tool box.

This magnetic socket track is even more useful, because it is made thinner by using a dual channel arrangement of magnetic segments rather than a single channel. A mechanic needs a thin socket holder, so that tall sockets mounted thereon can still be stored in a drawer of a tool case, as desired. In this fashion, because the drawer receives the thin tool holder with the sockets thereon, the drawer still functions as desired.

Also, the socket track needs to attach firmly to a drawer in order to hold its place. This invention, due to its thin, dual channel dovetail tracks, that hold the magnetic segments, not only accomplishes this feature, but also provides magnetism so powerful that it can secure a fully loaded socket track or socket track with the bit block of attachment to the side of the toolbox or any vertical ferrous metal surface.

Once the tool holder with the socket track has sockets attached thereto, individual metal sockets can be easily removed with a slight tilt and lift. The entire socket track can be relocated the same way, with a simple tilt and lift. In addition, with the bit block attached in order to hold appropriate driver bits, each of the bits is simply removed by lifting the desired bit or bits off of the magnetic surface of the track through their respective apertures in the bit block attachment.

Because it is customary in the trade to identify metric tools with a blue indicator and English tools with a red indicator, an interchangeable or reversible color indicator can run the length of the tool housing in order to indicate the type of tools on the tool holder. In this fashion, a mechanic can determine the tools thereon.

Some of the other features of this socket track include use thereof without pegs, in order to hold tools, such as screwdrivers, wrenches, and various other tools. There is a strong magnetic attraction to the tools.

Clearly, the tool holder can be mounted on any magnetically receptive surface. Such a magnetic mounting can be minimized by attaching a thin metal plate to the bottom of the tool holder. Then the tool holder is thus used without the magnetic characteristics of attaching to surface, when such is desired. For the housing of the tool holder, a nonferrous material having a long, slender shape is desired. Preferably, one longitudinal side of the housing tapers from top to bottom as a tapered side.

Also, preferably, there are three channels running the length of the housing. More preferably, there are four channels running the length of the housing. The nonferrous material can be plastic or metallic or combinations thereof. The key factor is that it be a durable material. It is also desirable that the nonferrous material be nonmagnetic.

With the three or more channels running longitudinally, the central channel or slot is a T-shaped channel, to receive the T-stud assembly. The dual magnet channels on either side of the T-shaped channel are preferably dovetailed and receive elongated magnets having that shape. The magnets are in as many pieces as desired to fill each dovetailed channel. Usually, two to six magnets are in each channel. More preferably, two to five magnets are in each channel. Most preferably, two to four magnets are in each channel. The number may vary with the length of the channel. The numbers apply to a housing, and hence the magnet channel in the housing being sufficiently long in order to receive the desired number of magnets. So usually, the magnet channel and the housing are about 20 to about 50 centimeters long.

If desired, in the tapered side of the housing is a channel, which may be a color channel. Into the color channel may be inserted a blue rod or blue color indicator when metric tools are present or a red rod color indicator when English tools are present. The color channel is an optional feature of the tool holders of this invention.

Many types of tools may be supported on the tool holder. For example, various wrenches and other ferrous or magnetically receptive tools may be mounted thereon. Also, various types and sizes of sockets, pliers, wrenches and other tools may be on the tool holder. Even bits; which include, but are not limited to, Phillips bits, flat bits, star bits and Allen wrench bits; may be applied thereto with the proper support.

Within the locking T-shaped slot is placed at least one T-shaped stud assembly. The T-shaped stud assembly has a sliding member of a non ferrous material. The sliding member has a platform within the slot with a rod protruding from the platform and above the slot. Fitted over the rod is a tightenable member capable of releasably fixing the platform, and hence the sliding member, in a desired position within the T-shaped slot. The tightenable member also serves as a peg to receive a desired socket.

Most preferably, the rod has male threads thereon, while the tightenable member has female threads adapted to receive the male threads. As the threads are tightened and the platform abuts the slot, the sliding member reaches a fixed position relative to the slot. The tightenable member may now receive a socket in a male to female relationship. Clearly, the outer diameter of the tightenable member is sufficient to receive the socket, and set in size depending on the size of the drive for the socket. While there may be some holding of the tools frictionally, the major holding force for tool holding is magnetic.

Even more desirable is the tightenable member having an outer ridged or slotted side, in order to provide for a better grip, when the tightenable member is loosened or tightened. A slight taper of the tightenable member adds to the gripping capability on the tightenable member. Such a taper also facilitates removal thereof from a mold during manufacture.

Preferably, the taper is up to about ten degrees. More preferably, the taper is about one degree to about nine degrees. Most preferably, the taper is about four degrees to about six degrees.

With the tightenable member having a threaded end and an unthreaded end, the taper preferably runs from the unthreaded end and narrows down to the threaded end. However, the taper may run in reverse. Whichever way the taper runs, the ridges and the taper cooperate to assist with the loosening and securing of the tightenable member.

Figure 2:
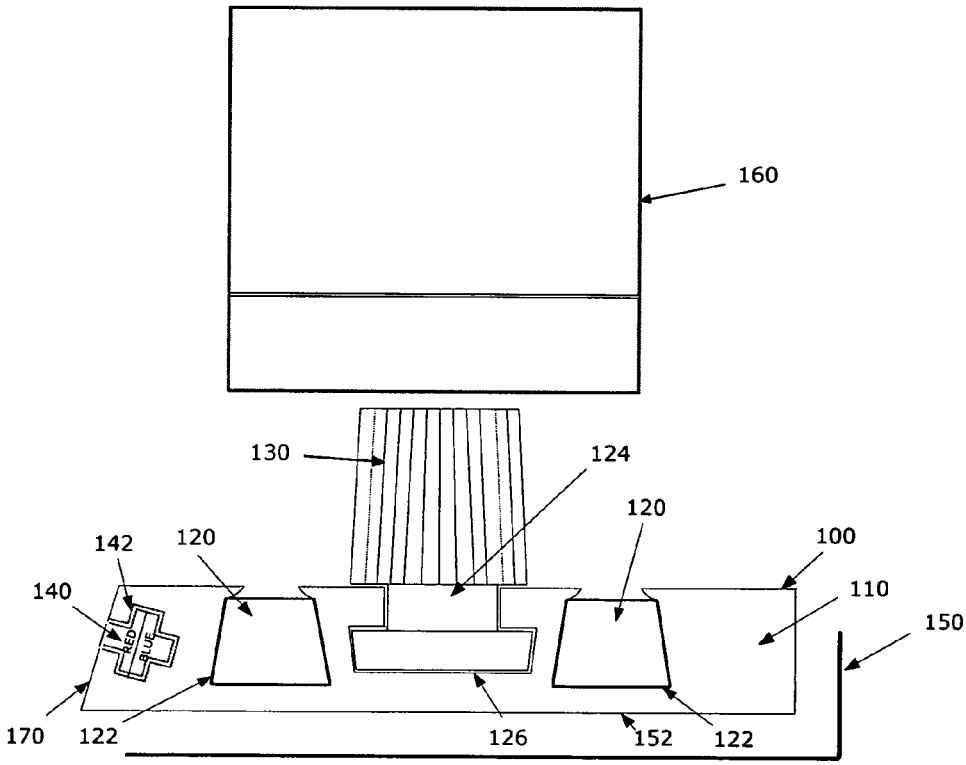
FIG. 2 depicts an end, plan view of the color bar housing 110 for tool holder 100 of this invention.

Referring now to FIG. 1 and FIG. 2, tool holder 100 has a housing 110, which acts as a nonferrous base plate. Into housing 110 fits a plurality of dovetail magnetic segments 120 at the pair of channels or dovetail channels 122 in housing 110. Between the two dovetail channels 122 for the threaded nonferrous T-shaped stud 124 is situated T-shaped stud channel 126. Preferably, the T-shaped stud channel 126 is substantially coplanar with an exposed surface of the magnetic segments 120 as mounted in the dovetail channels 122.

L-shaped magnetically receptive plate 150 is secured to the base 152 of housing 110, magnetically. This is especially useful, if the magnetic characteristics of the tool holder 100 and housing 110 are not desired. The sockets 160 or other tools are still held in place magnetically, but the tool holder itself will not attach to any ferrous surface until L-shaped magnetically receptive plate 150 is removed.

Adding FIG. 3 and FIG. 4 to the consideration, socket holder assembly 128 has a threaded nonferrous T-shaped stud 124 and a female threaded peg 130 with finger ridges 132 on the outside thereof. Threaded nonferrous T-shaped stud 124 includes a male threaded member 134 to cooperate with female threads of female threaded peg 130. Male threaded member 134 (a top plan view being shown thereof in FIG. 4) includes a slidable head 136. Slidable head 136 fits into T-shaped stud channel 126 and receives female threaded peg 130 onto male threaded member 134 to form the socket holder assembly 128. Tightening of female threaded peg 130 thereon positions T-shaped stud 124 therein and permits application of a socket 160 on tool holder 100 to be held there until use thereof is desired by dove tail magnetic segment 120.

Figure 5C:
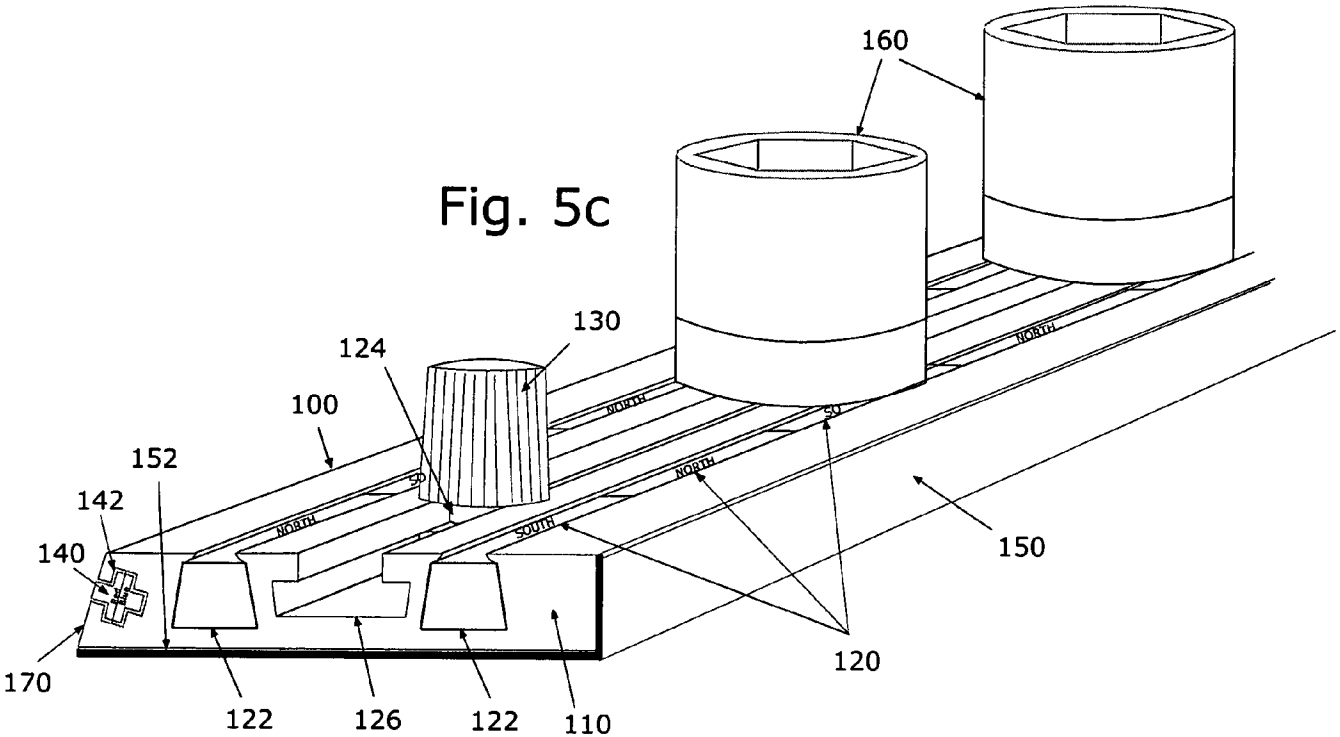
FIG. 5*c* depicts a perspective view of a for tool holder 100 of this invention with dovetail magnetic segments 120.

With the additional consideration of FIG. 5, FIG. 5*c* and FIG. 6, the trapezoidal structure or cross section of dovetail magnetic segment 120 becomes clear. Friction or glue may hold each dovetail magnetic segment 120 in dovetail magnetic segment channel 122. Sufficient numbers of dovetail magnetic segment 120 are placed in dovetail magnetic segment channel 122 in order to fill the same.

Turning now to the consideration of FIG. 4*a*, a colored rod 140 fits into a color channel 142. Colored rod 140 preferably has a cross section of an equal armed cross with blue on one longitudinal side and red on the other longitudinal side. Into the color channel 142 may be inserted the blue side of rod 140 as a blue color indicator along the side of housing 110, when metric tools are present or a red side of colored rod 140 or red color indicator when English tools are present.

Figures 7, 8:
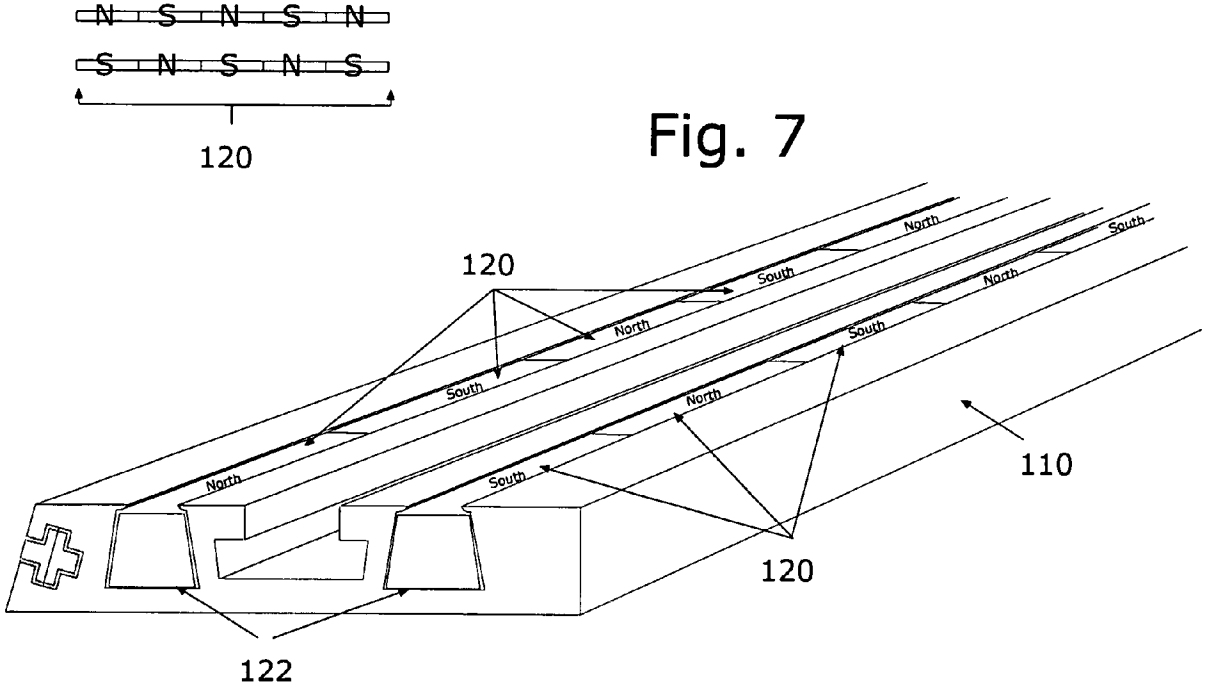
FIG. 7 depicts a perspective view of housing 110 for tool holder 100 of this invention with magnets 120 having a preferred arrangement.
FIG. 8 depicts a top plan view of magnets 120 having a preferred arrangement in housing 110 for tool holder 100.

Now adding FIG. 7 and FIG. 8 to consideration, the structure of housing 110 becomes more clear. Into housing 110 fits a plurality of dovetail magnetic segments 120 at the pair of dovetail channels 122 in housing 110. Between the two dovetail channels 122 for the threaded nonferrous T-shaped stud 124 is situated T-shaped stud channel 126.

Each of the pair of dovetail channels 122 in housing 110 has two dovetail magnetic segments 120 or more therein with T-shaped stud channel 126 positioned therebetween. In a preferred situation, adjacent dovetail magnets 120 have opposite polarities within each dovetail channel 122. Opposite magnets 120 in opposing dovetail channels 122 also have opposing polarities. Such an arrangement of magnets 120 creates an opposing polarity relationship and at least minimizes a magnetic attraction between adjacent sockets 160 on tool holder 100. This magnetic attraction between adjacent sockets 160, is believed to be magnetism, which can be induced in the sockets 160 by dovetail magnets, were it not for the opposing polarities.

In the tapered side 170 of the housing 110 is a colored rod 140 in a color channel 142. Colored rod 140 preferably has a cross-section of an equal armed cross with blue on one longitudinal side and red on the other longitudinal side. Into the color channel 142 may be inserted the blue side of rod 140 as a blue color indicator along the side of housing 110, when metric tools are present; or a red side of colored rod 140 or red color indicator when English tools are present, as is the industry standard.

Figure 9:
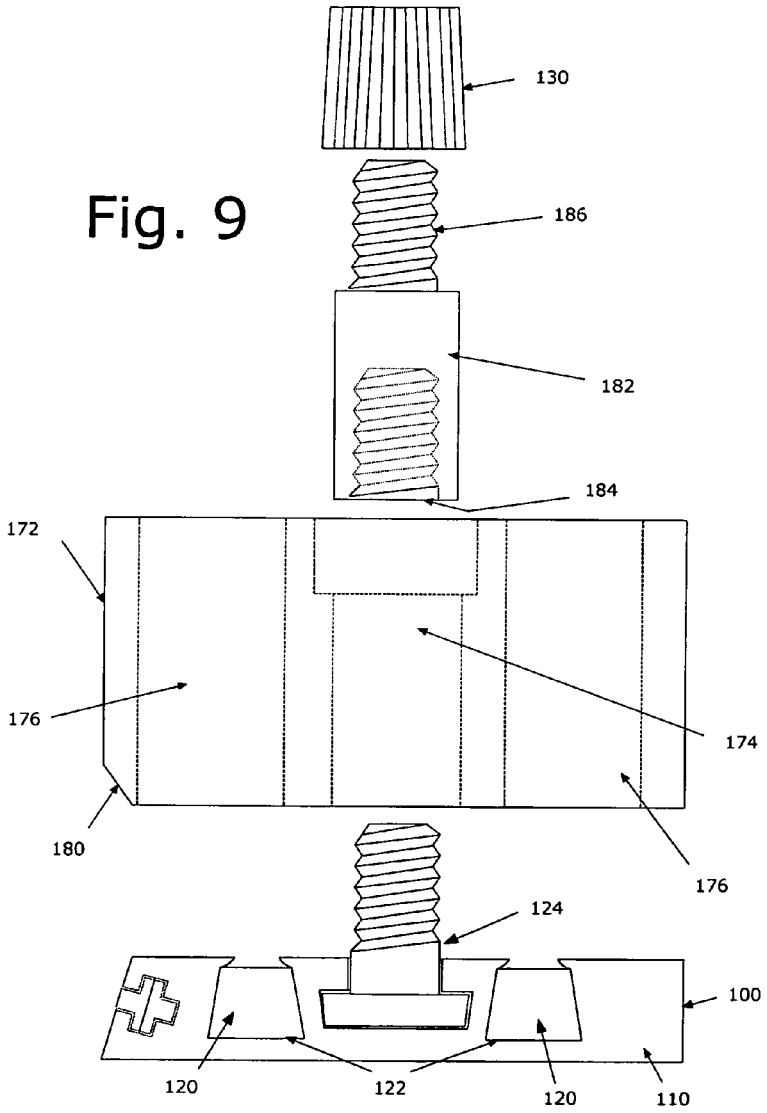
FIG. 9 depicts an exploded, end plan view of housing 110 for tool holder 100 of this invention having a bit block holder 172 thereon.
Figure 10:
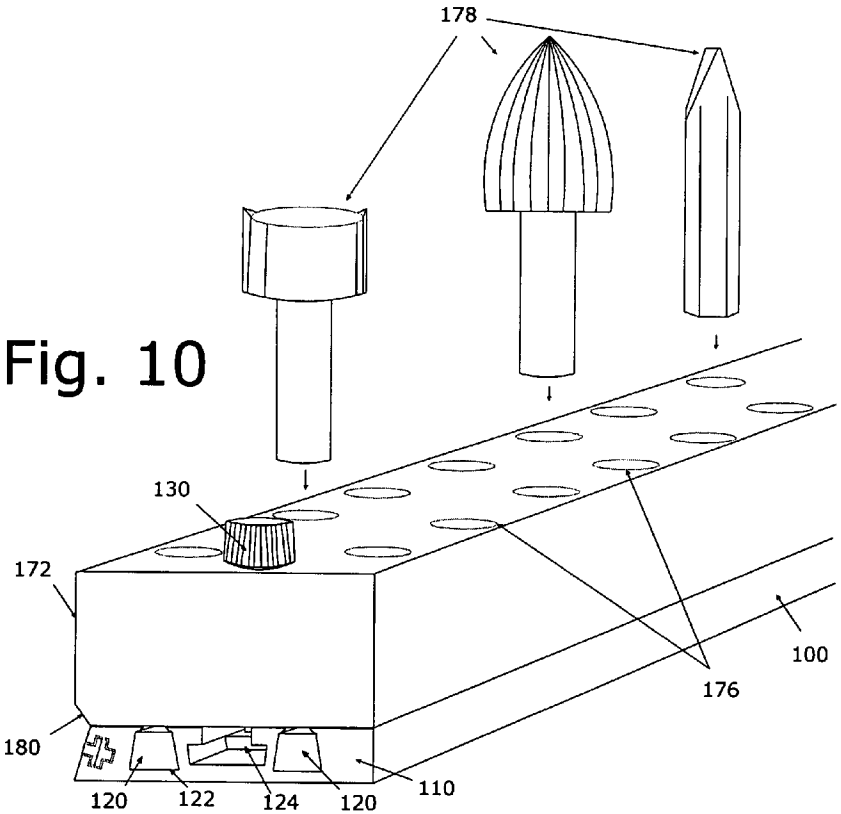
FIG. 10 depicts a perspective view of housing 110 for tool holder 100 of this invention having a bit block holder 172 thereon.
Figure 10A:
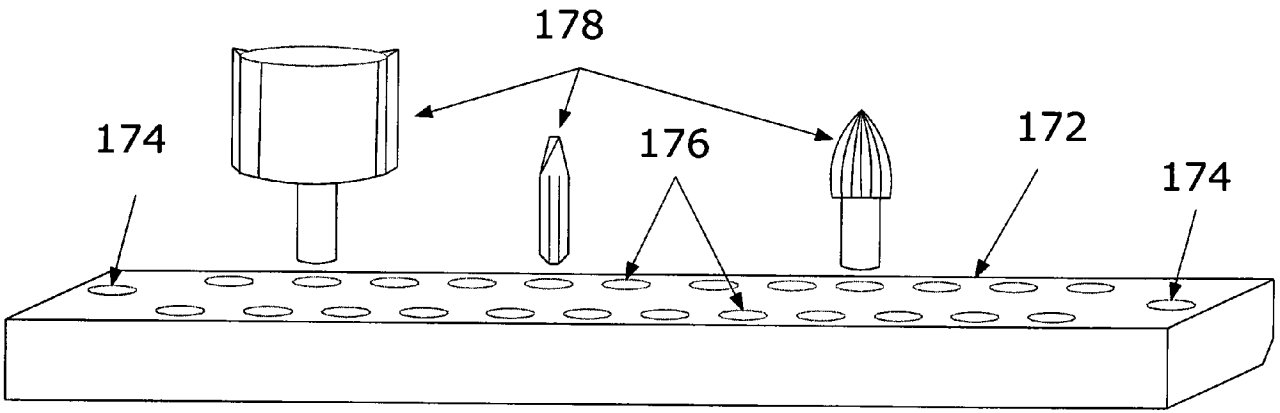
FIG. 10*a* depicts a perspective view of bit block holder 172 for housing 110 of tool holder 100 of this invention.

Further considering FIG. 9, FIG. 10 and FIG. 10*a*, the addition of bit block holder 172 may be attached to tool housing 110. Bit block holder 172 includes step aperture 174 at each end thereof. Step aperture 174 receives male threaded member 134 and extender 182. Extender 182 has a female end 184 with an oppositely disposed male threaded end 186. Male threaded member 134 receives female threaded end 184, while male threaded end 186 extends sufficiently into step aperture 174 or bit block 172 to receive rounded or circular female threaded peg 130 and lock bit block holder 172 onto housing 110.

Within bit block holder 172 are bit apertures 176, which can receive a variety of bits 178. Within the class of bits are included router bits, grinding bits, screw driver bits and other bits in use. Bit block holder 172 cooperates magnets 120, thereby holding bits 176 on holder 100 until use thereof is desired.

Sloped side 180 of bit block holder 172 is adjacent to housing 110 and color channel 142. With the top surface of housing 110 being adjacent to the bottom surface of bit block holder 172 and each having a substantially similar surface area, sloped side 180 and tapered side 170 facilitate alignment and separation of housing 110 and bit block holder 172 as desired.

Bit block holder 172 provides access to magnets 120 and permits various bits 178 to be held thereon. Bits 178 are held or stored on bit block holder 172, until use thereof is desired. Bit block holder 172 can also cover only part of housing 110 if desired, thereby permitting sockets 160 (FIG. 1) and bits 178 to be held thereon at the same time.

Figure 11:
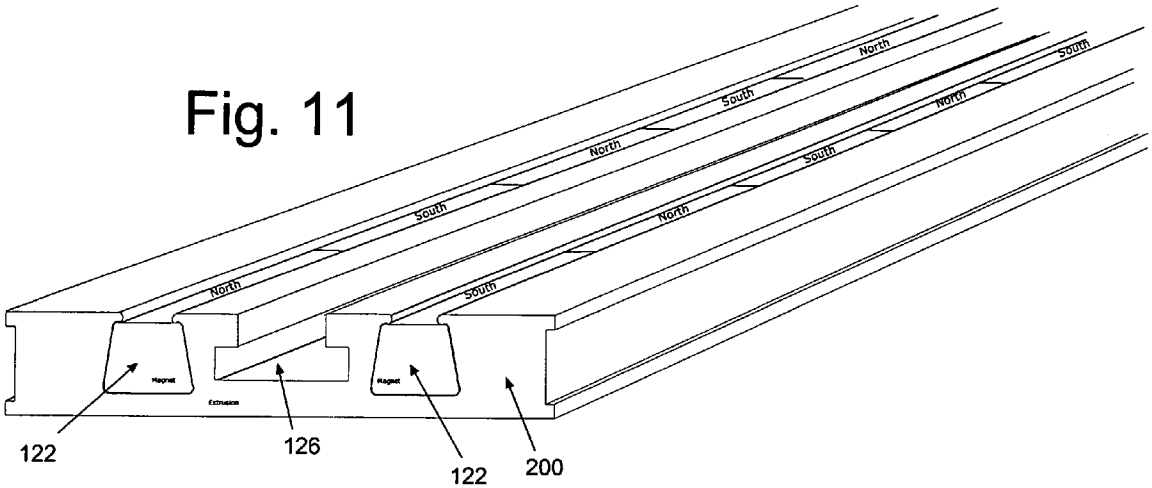
FIG. 11 depicts a perspective view of plain housing 200 for tool holder 100 of this invention with magnets 120 having a preferred arrangement.

Referring now to FIG. 11, tool holder 100 has a plain housing 200 to replace color housing 110 of FIG. 2. Like color housing 110, plain housing 200 acts as a nonferrous base plate, but without color channel 142 of FIG. 4*a*. Into plain housing 200 may fit a plurality of dovetail magnetic segments 120 at the pair of dovetail channels 122 as shown in FIG. 1 for color housing 110. Between the two dovetail channels 122 for the threaded nonferrous T-shaped stud 124 is situated T-shaped stud channel 126. Preferably, the T-shaped stud channel 126 is substantially coplanar with an exposed surface of the magnetic segments 120 as mounted in the dovetail channels 122.

Plain housing 200 may use first flat side 202 and second flat side 204 for gripping purposes. A taper is not required because of the absence of color channel 142 (FIG. 1). Plain housing 200 indicates that the housing shape can vary.

Figure 12:
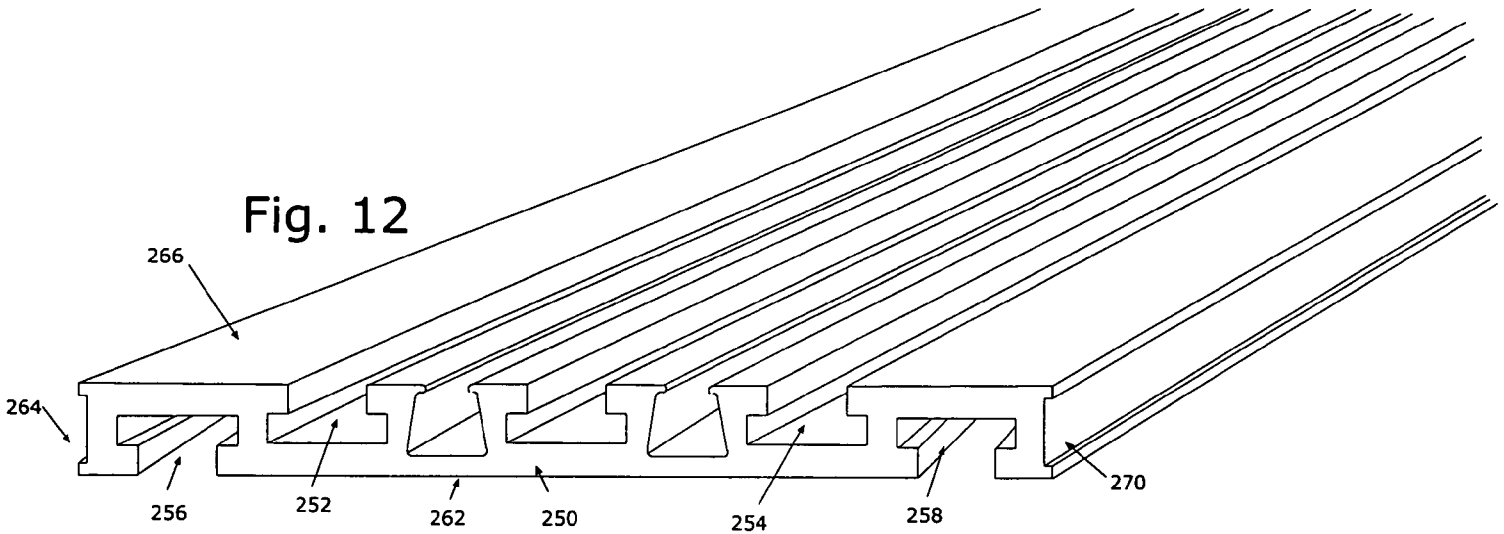
FIG. 12 depicts a perspective view of expanded housing 250 for tool holder 100 of this invention with magnets 120 having a preferred arrangement.

In FIG. 12 is a perspective view of expanded housing 250 for tool holder 100 of this invention with magnets 120 having the preferred arrangement of FIG. 1. Expanded housing 250 is very similar to plain housing 200, but is expanded to include a first outside tool channel 252 and a second outside tool channel 254. First outside tool channel 252 and second outside tool channel 254 are on opposite sides of expanded housing 250. More particularly, one of dovetail channels 122 is between first outside tool channel 252 and T-shaped stud channel 126. Then the other of dovetail channel 120 is between second outside tool channel 254 and T-shaped stud channel 126. T-shaped stud 124 (FIG. 2) can fit in these T-shaped channels 126 as well as tool channels 252 and 254.

First lower channel 256 and second lower channel 258 are present in expanded housing 250. More particularly, first lower channel 256 is adjacent to first outside tool channel 252, but on a bottom portion 262 of expanded housing 250 adjacent to the first edge 264 thereof. Clearly, first outside tool channel 252 is on a top portion 266 of expanded housing 252. It follows that second lower channel 258 is adjacent to second outside tool channel 254, but on a bottom portion 262 adjacent to the second edge 270 thereof.

Figure 13:
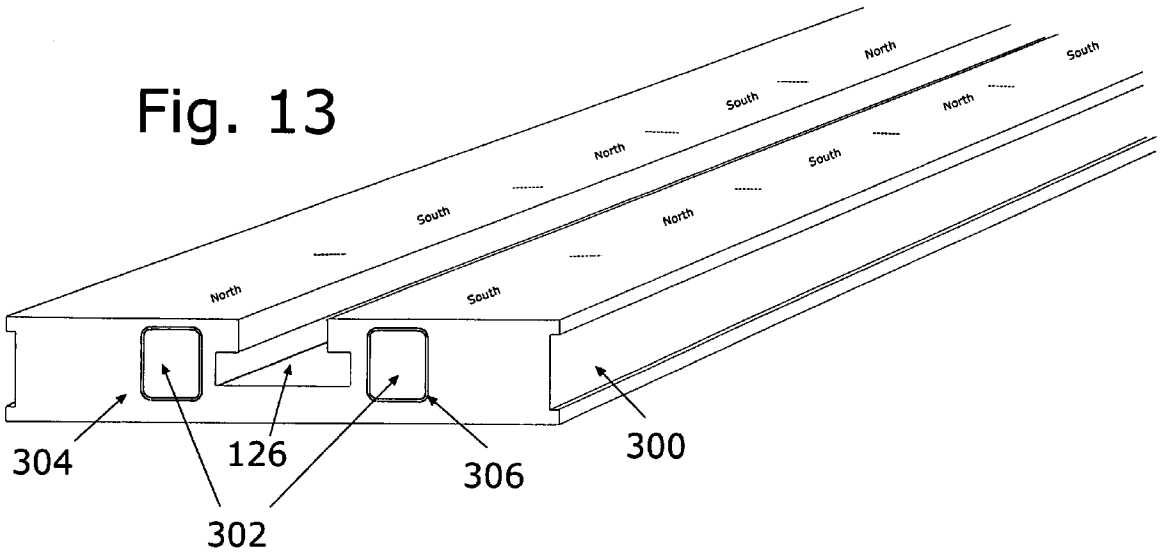
FIG. 13 depicts a perspective view of small enclosed housing 300 for tool holder 100 of this invention with magnets 120 having a preferred arrangement.

In FIG. 13 with small enclosed housing 300 for tool holder 100, shaped magnet segments 302 are present. More particularly shaped magnet segments 302 are mounted in first magnet tunnel 304 of this invention with magnet segments 304 having a preferred arrangement as set forth in FIG. 2, so that only an end of one magnet segment 302 shows. Likewise, there is a second magnet tunnel 306 receiving the shaped magnetic segments 302, as in dovetail channels 122, above described. The threaded nonferrous T-shaped stud 124 of FIG. 1 may also be situated in T-shaped stud channel 126 of small enclosed housing 300.

Figure 14:
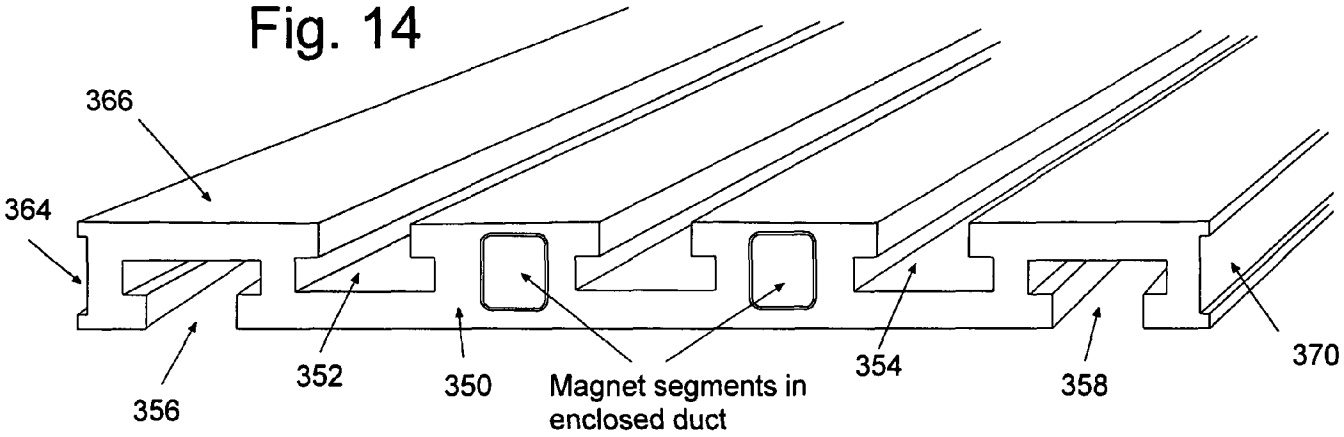
FIG. 14 depicts a perspective view of large enclosed housing 350 for tool holder 100 of this invention with magnets 120 having a preferred arrangement.

In FIG. 14, large enclosed housing 350, for tool holder 100 with magnet segments 302 having a preferred arrangement, expands on FIG. 13 and small enclosed housing 300. Large enclosed housing 350 has a first lower slot 356 and a second lower slot 358. More particularly, first lower slot 356 is adjacent to first outside tool receiver 352, but on a bottom section 362 of large enclosed housing 350 adjacent to the first side 364 thereof. Clearly, first outside tool receiver 352 is on a top section 366 of large enclosed housing 350. It follows that second lower slot 358 is adjacent to second outside tool receiver 354, but on a bottom section 362 adjacent to the second side 370 thereof.

Here in FIG. 14, as in FIG. 13, shaped magnet segments 302 are mounted in first magnet tunnel 304 of this invention with magnet segments 304 having a preferred arrangement as set forth in FIG. 2, so that only an end of one magnet segment 302 shows. Likewise, there is a second magnet tunnel 306, also receiving the shaped magnetic segments 302. The threaded nonferrous T-shaped stud 124 of FIG. 1 may also be situated in T-shaped stud channel 126 of large enclosed housing 350.

Figure 16:
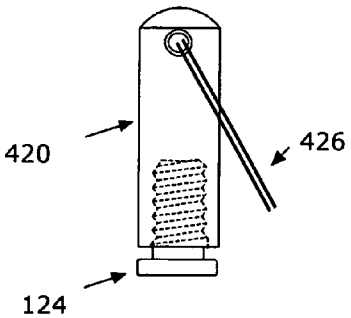
FIG. 16 depicts a side view of rail lifter 410.
Figure 15:
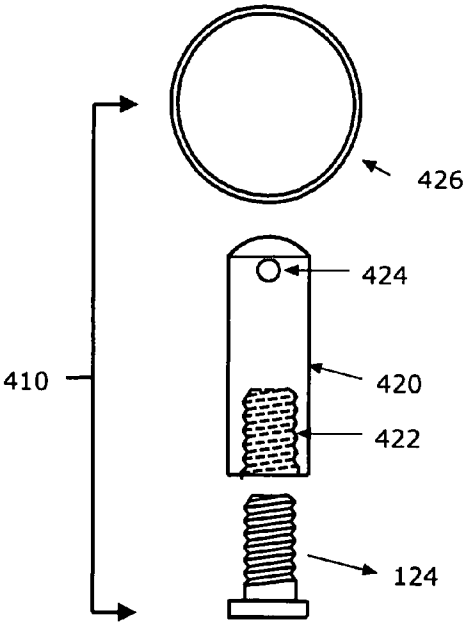
FIG. 15 depicts an exploded, side, view of rail lifter 410.
Figure 17:
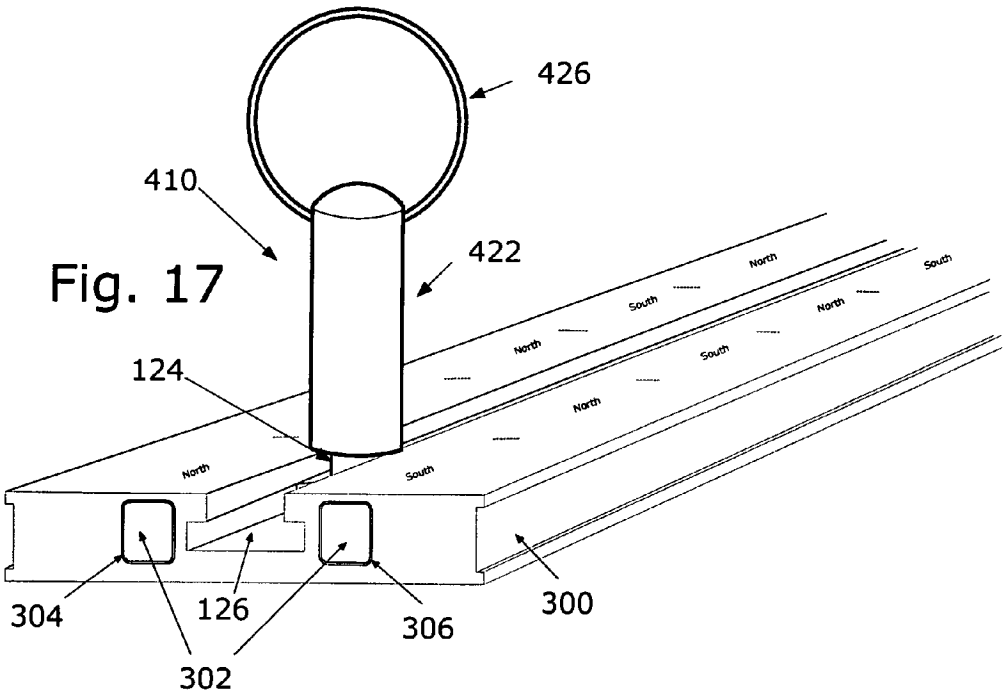
FIG. 17 depicts a perspective view of rail lifter 410 on small enclosed housing 300 of this invention.

With FIG. 15, FIG. 16, and FIG. 17; rail lifter 410 is added small enclosed housing 300 to facilitate lifting of housing 300. Rail lifter 410 includes T-shaped stud 124 fitting into T-shaped stud channel 126. However, lifting post extension 420 is threaded thereon at extension threads 422. Oppositely disposed from extension threads 422 in lifting post extension 420 is lifting aperture 424. Into lifting aperture 424 fits lifting ring 426, which preferably a split ring. Lifting ring 426 facilitates lifting of housing 300 or any other housing from cramped spaces. Thus housing 300 of this invention, as well the other housing of this invention may be lifted easily with tools 412 thereon.

The rail lifter 410 facilitates lifting of housing 300 or any other housing disclosed herein from any ferrous metal or magnetically receptive surface. By placing a finger (not shown) into lifting ring 426, magnetic tool holder 100 (FIG. 1), housing 300 or any housing disclosed herein may be easily removed and carried to another desired location. Preferably lifting aperture 424 is in a somewhat frictional relationship with lifting ring 426, so that lifting ring 426 might be left in a desired position.

Figure 19:
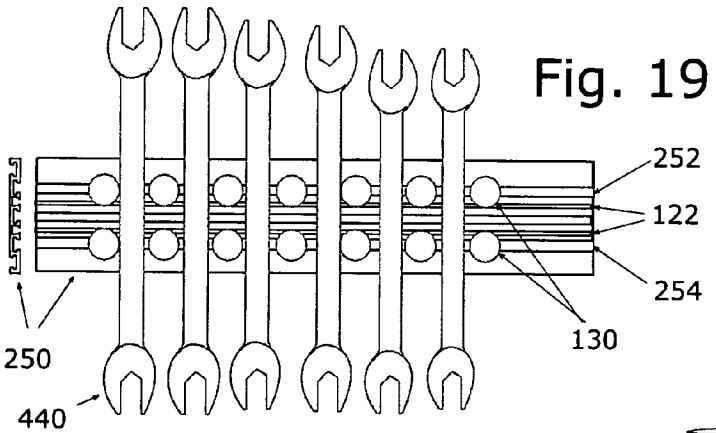
FIG. 19 depicts a top plan view of expanded housing 250 of this invention with wrenches 440 thereon.
Figure 18:
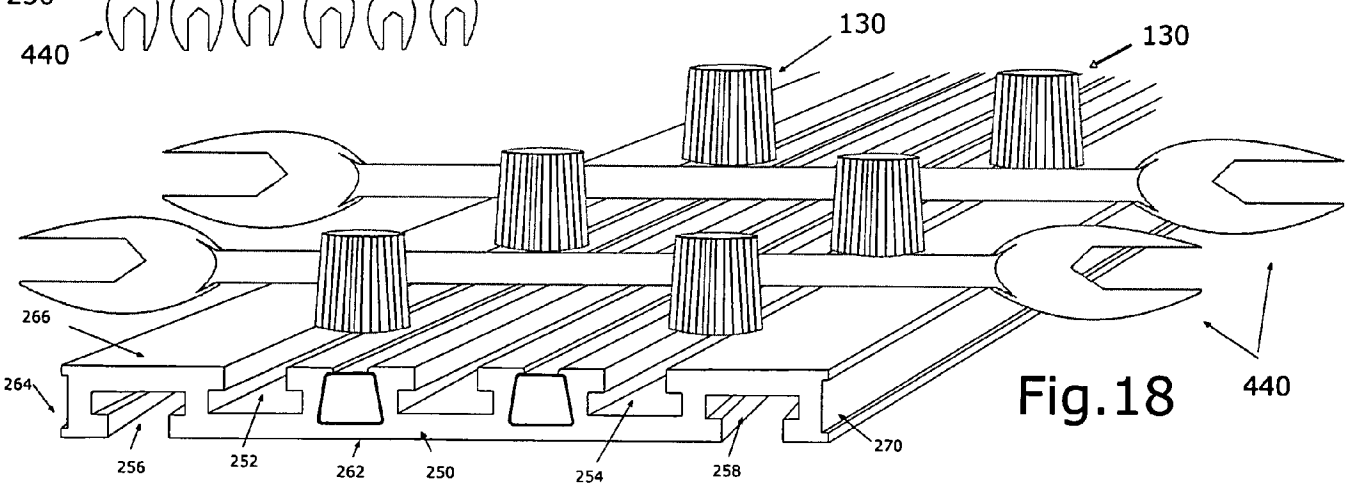
FIG. 18 depicts a perspective view of expanded housing 250 of this invention with wrenches 440 thereon.

Directing consideration to FIG. 18 and FIG. 19, tools 440 are depicted on expanded housing 250. Tools may be wrenches 440 or sockets, or other types of tools. The other housing structures disclosed herein are also useful for a wide variety of tools 440. Female threaded pegs 130 serve as dividers between wrenches 440, dovetail channels 122 hold magnets supporting the tools such as wrenches 440.

The purpose of the first lower slot 256 and the second lower slot 258 is that the user can turn expanded housing 250 over and mount female threaded pegs 130 therein in a standard fashion, in order to align wrenches 440 thereon. The magnetic force is thus about 30% less than the other mounting.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure modification of this method and device can become clear to a person having ordinary skill in this particular art. Such modifications are clearly covered by this disclosure.

What is claimed and sought to be protected by Letters Patent of the United States is:

1. A tool holder for holding tools in a desired position comprising:

a housing and a magnetic surface being combined with the housing to releasably support at least one tool on the tool holder;

the housing including at least a first channel and a second channel to receive the magnetic surface;

the tool holder having a low structure to facilitate use or storage thereof;

a slot being positioned between the channels to support at least one tool;

the tool holder being mountable on a magnetically receptive surface;

the housing being a large enclosed housing;

the housing being formed from a nonferrous material having a long, slender shape;

the first channel being a first magnet tunnel to receive at least a first magnetic segment therein;

the second channel being a second magnet tunnel to receive at least a second magnetic segment therein;

the slot being positioned between the first channel and the second channel;

the slot being a T-shaped stud channel;

the nonferrous material being nonmagnetic;

the large enclosed housing including a first outside tool channel and a second outside tool channel;

the first outside tool channel and the second outside tool channel being on opposite sides of the large enclosed housing;

the first magnet tunnel being between the first outside tool channel and the T-shaped stud channel;

the second magnet tunnel being between the second outside tool channel and the T-shaped stud channel;

the first outside tool channel and the second outside tool channel being T-shaped;

a T-shaped stud fitting in the first outside tool channel and the second outside tool channel;

a first lower channel and a second lower channel being present in an expanded housing;

the first lower channel being adjacent to a first outside tool channel and on a bottom portion of the expanded housing adjacent to a first edge thereof;

the second lower channel being adjacent to a second outside tool channel and on a bottom portion of the expanded housing adjacent to a second edge thereof;

the housing being nonferrous material and nonmagnetic;

the housing being formed of at least one of a plastic material, a metallic material, and a plastic and metallic combination;

the slot being a T-shaped channel;

the T-shaped channel receiving a T-stud assembly;

at least two movable pegs being mounted on the housing;

the at least two movable pegs each including a sliding member of a non ferrous material and a tightenable member;

the tightenable member being rounded in to facilitate placing a tool on the tool holder;

the sliding member having a platform within the slot with a rod protruding from the platform above the slot;

the tightenable member fixing the platform in a desired position within the T-shaped slot;

the rod having male threads thereon to form a male threaded member;

the tightenable member having female threads as a female threaded member thereon adapted to receive the male threads of the male threaded member;

the tightenable member having an outer ridged side;

the tightenable member having a threaded end and an unthreaded end;

the tightenable member having a slight taper in order to provide gripping capability and in order to facilitate removal thereof from a mold during a manufacturing process;

the slight taper being up to about ten degrees; and the slight taper running from the unthreaded end and narrowing down to the threaded end.

2. A tool holder for holding tools in a desired position comprising:

a housing and a magnetic surface being combined with the housing to releasably support at least one tool on the tool holder;

the housing including at least a first channel and a second channel to receive the magnetic surface;

the tool holder having a low structure to facilitate use or storage thereof;

a slot being positioned between the channels to support at least one tool;

at least one peg being supported in the slot for the at least one tool;

the housing being a plain housing;

the first channel and the second channel being a first dovetail channel and a second dovetail channel respectively;

the magnetic surface being at least two dovetail magnets in each of the first channel and the second channel;

the plain housing acting as a nonferrous base plate;

the slot being a T-shaped stud channel;

the T-shaped stud channel being substantially coplanar with an exposed surface of the at least two dovetail magnets as mounted in the dovetail channels;

the plain housing having a first flat side oppositely disposed from a second flat side for gripping purposes;

the housing being an expanded housing;

the first channel and the second channel being dovetail channels;

the magnetic surface being at least two dovetail magnets in each of the first channel and the second channel;

the slot being a T-shaped stud channel;

the T-shaped stud channel being substantially coplanar with an exposed surface of the at least two dovetail magnets as mounted in the dovetail channels;

the expanded housing including a first outside tool channel and a second outside tool channel;

the first outside tool channel and the second outside tool channel being on opposite sides of the expanded housing;

the first dovetail channel being between the first outside tool channel and the T-shaped stud channel;

the second dovetail channel being between the second outside tool channel and the T-shaped stud channel;

the first outside tool channel and the second outside tool channel being T-shaped;

the T-shaped stud fitting in the first outside tool channel and the second outside tool channel;

a first lower channel and a second lower channel being present in the expanded housing;

the first lower channel being adjacent to first outside tool channel and on a bottom portion of the expanded housing adjacent to a first edge thereof;

the second lower channel being adjacent to second outside tool channel and on a bottom portion of the expanded housing adjacent to a second edge thereof;

the tool holder being mountable on a magnetically receptive surface;

the housing being a small enclosed housing;

the housing including at least a the first channel and the second channel to receive the magnetic surface;

the housing being formed from a nonferrous material having a long, slender shape;

the slot being positioned between the first channel and the second channel;

the slot being a T-shaped stud channel;

the nonferrous material being nonmagnetic;

the tool holder being mountable on a magnetically receptive surface;

the housing being a large enclosed an expanded housing;

the housing including at least a the first channel and the second channel to receive the magnetic receptive surface;

the housing being formed from a nonferrous material having a long, slender shape;

the slot being positioned between the first channel and the second channel;

the slot being a T-shaped stud channel to receive a T-shaped stud;

the nonferrous material being nonmagnetic;

the large enclosed housing including a first outside tool channel and a second outside tool channel;

the first outside tool channel and the second outside tool channel being on opposite sides of the large enclosed housing;

the first outside tool channel and the second outside tool channel each being a T-shaped channel;

the T-shaped stud fitting in the first outside tool channel and the second outside tool channel;

a first lower channel and a second lower channel being present in the expanded housing;

the first lower channel being adjacent to the first outside tool channel and on a bottom portion of the expanded housing adjacent to a first edge thereof;

the second lower channel being adjacent to the second outside tool channel and on a bottom portion of the expanded housing adjacent to a second edge thereof;

the housing being nonferrous material and nonmagnetic;

the housing being formed of at least one of a metallic material, a plastic material, or metallic material or combinations thereof;

the T-shaped channel receiving a T-shaped stud assembly;

at least two movable pegs being mounted on the housing;

the at least two movable pegs each including a sliding member of a non-ferrous material and a tightenable member;

the sliding member having a platform within the slot with a rod protruding from the platform above the slot;

the tightenable member fixing the platform in a desired position within the T-shaped channel;

the tightenable member being rounded in order to facilitate placing the tool on the tool holder;

the rod having male threads thereon;

the tightenable member having female threads thereon adapted to receive the male threads;

the tightenable member having an outer ridged side;

the tightenable member having a threaded end and an unthreaded end;

the tightenable member having a slight taper in order to provide gripping capability and in order to facilitate removal thereof from a mold during a manufacturing process;

the slight taper being up to about ten degrees; and the slight taper running from the unthreaded end and narrowing down to the threaded end.

3. The tool holder of claim 2 further comprising:

a) the magnetic surface including at least a first magnetic segment and a second magnetic segment adjacently positioned in the first channel, and a third magnetic segment and a fourth magnetic segment adjacently positioned in the second channel;

b) the first magnetic segment having a first magnetic polarity;

c) the second magnetic segment having a second magnetic polarity;

d) the third magnetic segment having a third magnetic polarity;

e) the fourth magnetic having a fourth magnetic polarity;

f) the first magnetic segment being oppositely disposed from the third magnetic segment;

g) the second magnetic segment being oppositely disposed from the fourth magnetic segment; and h) the first magnetic polarity being opposite the third magnetic polarity, and opposite the second magnetic polarity and the same as the fourth magnetic polarity, thereby forming an opposing polarity relationship in order to facilitate maximization of magnetic attraction flow through at least one tool mounted on the tool holder.

4. The tool holder of claim 3 further comprising:

a) the magnetic surface further including at least one additional dovetail magnetic segment positioned in the first channel and at least one further dovetail magnetic segment positioned in the second channel; and b) the opposing polarity relationship being maintained.

5. The tool holder of claim 4 further comprising:

a) the housing including a rail lifter to facilitate lifting of the housing;

b) the rail lifter including a T-shaped stud and a lifting post extension;

c) the T-shaped stud having extension threads to receive the lifting post extension;

d) the lifting post extension including a lifting aperture; and e) the lifting aperture receiving a lifting ring to facilitate lifting of the housing.

6. The tool holder of claim 5 further comprising:

a) the lifting aperture having a frictional relationship with the lifting ring in order to place the ring in a desired position and facilitate lifting of the tool holder; and b) an L-shaped magnetically receptive plate being releasably secured to a base of the housing, in order to prevent an attachment of the tool holder to a ferrous surface, while maintaining an ability to support tools on the tool holder.

7. The tool holder of claim 6 further comprising:

a) a bit block holder being attached to the tool housing;

b) the bit block holder having a first step aperture at a first block end thereof;

c) the bit block holder having a second step aperture at a second block end thereof; and d) the first step aperture being oppositely disposed from the second step aperture.

8. The tool holder of claim 7 further comprising:

a) the first step aperture receiving a first member of a male threaded member;

b) the second step aperture receiving a second member of the male threaded member;

c) a first extender passing through the first step aperture and receiving the first member of the male threaded member;

d) a second extender passing through the second step aperture and receiving the second member of the male threaded member;

e) the first extender receiving a first item of the tightenable member in order to hold the bit block in place;

f) the second extender receiving a second item of the tightenable member in order to hold the bit block in place; and g) the bit block holder including at least two bit apertures to receive any desired bit or bits.

9. The tool holder of claim 8 further comprising:

a) the bit block holder having a sloped side and a tapered side;

b) the sloped side being adjacent to the tapered side of the housing;

c) a bottom surface of the bit block holder and a top surface of the housing having a substantially similar surface area; and d) the bit block holder releasably and magnetically holding the bits.

10. The tool holder of claim 9 further comprising:

a) the bit block holder being shorter than the housing in order to hold the bits and sockets as desired;

b) the tightening member having a variety of peg sizes; and c) the magnetic surface serving to position the tool holder on a ferrous surface.

* * * * *